US011913102B2

(12) United States Patent
Tang et al.

(10) Patent No.: US 11,913,102 B2
(45) Date of Patent: Feb. 27, 2024

(54) TITANIUM-COPPER ALLOY STRIP CONTAINING NB AND AL AND METHOD FOR PRODUCING SAME

(71) Applicant: NINGBO BOWAY ALLOY PLATE & STRIP CO., LTD., Ningbo (CN)

(72) Inventors: Ning Tang, Ningbo (CN); Zhenkai Zhang, Ningbo (CN); Yuepeng Zhi, Ningbo (CN); Jian Yang, Ningbo (CN); Bo Wu, Ningbo (CN)

(73) Assignee: NINGBO BOWAY ALLOY PLATE & STRIP CO., LTD., Ningbo (CN)

( * ) Notice: Subject to any disclaimer, the term of this patent is extended or adjusted under 35 U.S.C. 154(b) by 136 days.

(21) Appl. No.: 17/423,698

(22) PCT Filed: Feb. 18, 2021

(86) PCT No.: PCT/CN2021/076741
§ 371 (c)(1),
(2) Date: Jul. 16, 2021

(87) PCT Pub. No.: WO2021/258747
PCT Pub. Date: Dec. 30, 2021

(65) Prior Publication Data

US 2022/0341001 A1 Oct. 27, 2022

(30) Foreign Application Priority Data

Jun. 24, 2020 (CN) ..... 202010586105.5

(51) Int. Cl.
*C22C 9/01* (2006.01)
*C21D 8/02* (2006.01)
(Continued)

(52) U.S. Cl.
CPC ..... *C22C 9/01* (2013.01); *C21D 8/0236* (2013.01); *C21D 8/0268* (2013.01); *C22C 1/03* (2013.01); *C22C 14/00* (2013.01); *C22C 27/02* (2013.01)

(58) Field of Classification Search
CPC .. C21D 8/0226; C21D 8/0236; C21D 8/0268; C22C 1/03; C22C 14/00; C22C 27/02;
(Continued)

(56) References Cited

U.S. PATENT DOCUMENTS

2006/0239853 A1* 10/2006 Maehara ..... B22D 21/025 420/492

FOREIGN PATENT DOCUMENTS

CN 102822362 A 12/2012
CN 110923499 A 3/2020
(Continued)

OTHER PUBLICATIONS

NPL: on-line translation of JP-2005113259-A, Apr. 2005 (Year: 2005).*

*Primary Examiner* — Jie Yang
(74) *Attorney, Agent, or Firm* — COOLEY LLP

(57) ABSTRACT

The present invention discloses a Nb and Al-containing titanium-copper alloy strip, characterized in that the weight percentage composition of the titanium-copper alloy strip comprises: 2.00-4.50 wt % Ti, 0.005-0.4 wt % Nb, and 0.01-0.5 wt % Al, balance being Cu and unavoidable impurities. Preferably, in the microstructure of the titanium-copper alloy strip, the number of Nb and Al-containing intermetallic compound particles with a particle size of 50-500 nm is not less than $1\times10^5/mm^2$, and the number of Nb and Al-containing intermetallic compound particles with a particle size greater than 1 μm is not more than $1\times10^3/mm^2$. Under the condition of ensuring excellent bendability,
(Continued)

the titanium-copper alloy strip has excellent stability, especially the stability of mechanical properties at high temperatures. The present invention also relates to a method for producing the titanium-copper alloy strip.

6 Claims, 3 Drawing Sheets

(51) Int. Cl.
*C22C 1/03* (2006.01)
*C22C 14/00* (2006.01)
*C22C 27/02* (2006.01)

(58) Field of Classification Search
CPC .... C22C 9/01; C22F 1/002; C22F 1/02; C22F 1/08
USPC ..... 420/489
See application file for complete search history.

(56) References Cited

FOREIGN PATENT DOCUMENTS

| | | | | | |
|---|---|---|---|---|---|
| JP | 2005113259 A | * | 4/2005 | ..... | C22C 9/00 |
| JP | 2015-091603 A | | 5/2015 | | |

* cited by examiner

TITANIUM-COPPER ALLOY STRIP CONTAINING NB AND AL AND METHOD FOR PRODUCING SAME

RELATED APPLICATIONS

The present application is a U.S. National Phase application, filed under 35 U.S.C. § 371(c), of International Application No. PCT/CN2021/076741, filed Feb. 18, 2021, which claims priority to, and the benefit of, Chinese Patent Application Number 202010586105.5, filed on Jun. 24, 2020. The entire contents of each of which are herein incorporated by reference.

TECHNICAL FIELD

The present invention belongs to the technical field of copper alloy materials, particularly relates to a titanium-copper alloy strip containing Nb and Al. The titanium-copper alloy strip has excellent stability, especially the stability of mechanical properties at high temperatures. The present invention also relates to a method for producing the titanium-copper alloy strip.

BACKGROUND ART

With the rapid development of miniaturization and multi-functionalization of consumer electronics and other connector-related products, designers need to choose copper alloy materials with higher strength and better formability to manufacture the contacts to meet the design requirements of lightweight and miniaturization of their terminal products. In the existing copper alloy system, beryllium copper alloy, which is a representative of high strength and high conductivity, can meet the above requirements of properties. However, the use of beryllium containing materials is limited due to the cost and the production of highly toxic substances in the processing. Titanium-copper alloy is a copper alloy with titanium as the main alloy element, which has high strength and excellent formability. It can be used to replace beryllium copper alloy in some applications.

Titanium-copper is a kind of spinodal decomposition strengthening and aging precipitation strengthening alloy. The main strengthening microstructure is spinodal decomposition microstructure and β'-$Cu_4$ Ti phase. In the early stage of aging treatment, the strengthening mode of titanium-copper alloy is spinodal decomposition strengthening. Ti atoms solubilized in the copper matrix diffuse to form periodic Ti atom-rich regions in the crystal grains, that is, the spinodal decomposition microstructure. With the continuation of the aging process, the spinodal decomposition microstructure gradually transforms into periodically arranged β'-$Cu_4$Ti phase. However, the spinodal decomposition microstructure and β'-$Cu_4$Ti phase have poor stability at high temperatures and are prone to evolution, which will adversely affect the mechanical properties of the alloy. The higher the temperature, the faster the deterioration of its properties. In the process of material processing and application, the stability of material properties is very important. Good stability can ensure that the product will not fail quickly when there is a sudden overload and high temperature during processing and application. Because titanium-copper has high strength and excellent elastic properties, it has a wide range of application prospects in electric vehicles, 5G communication base stations and other fields. In these fields, especially in the field of electric vehicles, there are often instantaneous or continuous high-temperature operating conditions, and the temperature may reach 200° C. or higher. If the material is developed without considering the stability of the mechanical properties of the material at high temperature and the changes in the properties of the material after use under high temperature conditions, this will lead to an uncertainty of the service life of the components made of this material under high temperature conditions, and even the risk of sudden failure of the components, resulting in greater safety hazards. Therefore, when designing the titanium-copper alloy material system, only regulating the conventional strength, electrical conductivity, workability, etc., cannot fully meet the requirements of various subsequent processing and application of the material. While considering the conventional properties, the stability of the properties of the titanium-copper alloy should also be considered, especially the stability of the mechanical properties at high temperatures.

The search by the present inventor indicates that so far there is no research on the stability of the mechanical properties of the titanium-copper alloy strip at high temperature in the prior arts.

SUMMARY OF THE INVENTION

The present invention develops a Cu—Ti—Nb—Al system alloy by incorporating a certain amount of Nb and Al to the titanium-copper simultaneously. Compared with conventional titanium-copper alloys, the Cu—Ti—Nb—Al system alloy has significantly improved stability of mechanical properties at high temperatures and improved strength while ensuring excellent bendability.

The technical problem to be solved by the present invention is: in view of the disadvantages of the prior arts, how to make the alloy strip have optimized stability, especially the stability of mechanical properties at at high temperatures while ensuring the excellent mechanical properties and bendability of the titanium-copper alloy strip.

The technical solution adopted by the present invention to solve the above technical problems is: a titanium-copper alloy strip containing Nb and Al, the weight percentage composition of the titanium-copper alloy strip comprises: 2.0-4.5 wt % Ti, 0.005-0.4 wt % Nb, 0.01-0.5 wt % Al, balance being Cu and unavoidable impurities.

In the present invention, 2.0-4.5 wt % of Ti is added to the titanium-copper alloy strip. Ti helps to improve the mechanical properties of titanium-copper alloys. When the added Ti content is less than 2.0 wt %, the titanium-copper alloy strip cannot obtain ideal mechanical properties although it has a higher electrical conductivity, and thus is limited in application. When the added Ti content is greater than 4.5 wt %, excessively high Ti content will reduce the electrical conductivity of the alloy strip and significantly deteriorate its workability, especially the bendability. Therefore, the Ti content of the titanium-copper alloy strip in the present invention is 2.0-4.5 wt %. Preferably, the Ti content of the titanium-copper alloy strip is 2.5-4.0 wt %. More preferably, the Ti content of the titanium-copper alloy strip is 2.9-3.5 wt %.

In the present invention, Ti is the main strengthening element. In the aging process, the spinodal decomposition microstructure is first formed by the diffusion of Ti atoms in the solid solution. At this time, the strength of the copper alloy increases significantly; with the increase of the aging time, needle-like β'-$Cu_4$Ti phase is gradually precipitated in the matrix, and the aging strengthening effect gradually reaches its peak during this process; as the aging time is further extended, flaky β'-$Cu_4$Ti phase will be precipitated on the grain boundary, and its volume fraction will gradually increase with time, and will eventually replace the β'-$Cu_4Ti$ phase, and the strengthening effect of the copper alloy gradually decreases during this process. The spinodal decomposition microstructure is a uniform nano-scale microstructure, and the β'-$Cu_4Ti$ phase is also a nano-scale precipitation phase, which is dispersed in the matrix. Both of these microstructures can hinder the movement of grain boundaries and dislocations and thus increase the strength of the copper alloy. By controlling the aging process, it means the formation of different micromicrostructures, which can effectively control the comprehensive properties of the alloy.

The prior arts show that a small amount of any one of Nb and Al can be optionally added as a secondary alloying element in a titanium-copper alloy. On the one hand, when only Nb is added, it can solubilize in a small amount in the copper matrix, which slightly improves the strength of the alloy, but has little effect on other properties. However, due to the high melting point of Nb (its melting point being much higher than that of copper and other alloying elements commonly used in copper alloys), beneficial effects cannot be achieved by conventional production process, on the contrary, the application properties of the alloy is affected since Nb cannot solubilize in the copper matrix. On the other hand, the solid solubility of Al in the copper matrix is about 8%. In theory, the addition of Al may have a certain solid solution strengthening effect. However, it has been found by experiments that the addition of Al alone has no significant effect on the properties of titanium-copper.

In the present invention, 0.005-0.40 wt % of Nb and 0.01-0.50 wt % of Al are added to the titanium-copper alloy strip. The inventor has found that the simultaneous addition of the above amounts of Nb and Al can significantly improve the strength and the stability of the mechanical properties at high temperatures of the titanium-copper alloy strip while still ensuring excellent bendability. It has been found by experiments that after adding Nb and Al simultaneously, a dispersed nano-scale intermetallic compound containing Nb and Al will be formed in the alloy matrix, which has a dispersion strengthening effect on the titanium-copper alloy. This strengthening effect is more significant than addition of Nb or Al alone for the improvement of the mechanical properties of the alloy. These fine particles of Nb and Al-containing intermetallic compounds are dispersed in the alloy matrix, with a particle size of about 10 nm to 10 μm. The dispersed nanoparticles in the alloy will hinder the movement of dislocations and exhibit the effect of dispersion strengthening, thereby improving the mechanical properties of the alloy.

More importantly, Nb and Al-containing intermetallic compounds are intermetallic compounds with high melting point and high stability, with melting point up to 1900° C. or higher, and will not interact with the copper matrix at high temperatures, and thus still exhibit strengthening effect at high temperature. Compared with the conventional titanium-copper alloy, the Cu—Ti—Nb—Al alloy of the present invention has significantly improved stability of the mechanical properties of the alloy at high temperatures.

When the content of Nb is less than 0.005 wt % and Al is less than 0.01 wt % in the titanium-copper alloy strip, the number of Nb and Al-containing intermetallic compound particles containing Nb and Al is less, and the stability of mechanical properties of the alloy at high temperature is not significantly improved. The improvement of the properties of the Cu—Ti—Nb—Al alloy of the present invention relative to the conventional titanium-copper alloy is mainly due to the dispersion strengthening effect of the highly stable nanoparticles. However, when the Nb content is greater than 0.40 wt. %, and the Al content is greater than 0.5 wt % in the titanium-copper alloy strip, the number of Nb and Al-containing intermetallic compound particles in the alloy is excessive, the agglomeration of particles easily occurs during the production, and eventually adversely affect the properties of the alloy (especially the yield strength and bendability). Therefore, in the titanium-copper alloy strip of the present invention, the Nb content is 0.005-0.40 wt %, and the Al content is 0.01-0.5 wt %, and both elements need to be added simultaneously. More preferably, the Nb content is 0.01-0.30 wt %, and the Al content is 0.05-0.3 wt %.

Preferably, in the titanium-copper alloy strip, the number of Nb and Al-containing intermetallic compound particles with a particle size of 50-500 nm is not less than $1\times10^5/mm^2$, and the number of Nb and Al-containing intermetallic compound particles with a particle size greater than 1 μm is not higher than $1\times10^3/mm^2$. As shown in the scanning electron micrograph of FIG. 5, the titanium-copper alloy of the present invention has a large amount of dispersed fine granular Nb and Al-containing intermetallic compounds inside the crystal grains. The research indicates that it is advantageous in the titanium-copper alloy strip of the present invention that the number of Nb and Al-containing intermetallic compound particles with a particle size (the maximum size of the compound particles, the same below) of 50-500 nm is not less than $1\times10^5/mm^2$, and the number of Nb and Al-containing intermetallic compound particles with a particle size greater than 1 μm is not higher than $1\times10^3/mm^2$. The dispersed nano-scale particles can pin the dislocations, effectively hinder the movement of the dislocations, restrict the growth of grains and strengthen the alloy matrix. Importantly, due to the high stability of Nb and Al-containing intermetallic compounds at high temperatures, their strengthening effect still exists at high temperatures. It has been found in the present invention that when the particle size of the intermetallic compound particles is too large, the agglomeration of the particles will increase, which in turn deteriorate the strength and bendability of the material. Therefore, the number of Nb and Al-containing intermetallic compound particles with a particle size greater than 1 μm is preferably not higher than $1\times10^3/mm^2$. The present inventor found that by controlling a certain amount of nano-scale Nb and Al-containing intermetallic compound particles in the titanium-copper alloy matrix, the stability of the mechanical properties of the titanium-copper alloy at high temperatures can be further improved.

The applicant wishes to emphasize that the synergistic effect of Nb and Al is the most important factor for improving the stability of the high-temperature mechanical properties of the Cu—Ti alloy system in the present invention. It has been found through experiments that: in the Cu—Ti alloy system, when Nb is added alone, the strength of the alloy is improved, but the mechanical properties of the alloy at high temperature are not improved; when Al is added alone, all the properties of the alloy are not significantly improved; when Nb and Al are added simultaneously, dispersed Nb and Al-containing intermetallic compound particles are formed in the Cu—Ti—Nb—Al alloy matrix. The test results of the finished product show: Cu—Ti—Nb—Al alloy has significantly improved stability of mechanical properties at high temperatures and improved electrical conductivity. Therefore, the co-addition of Nb and Al can improve the stability of the mechanical properties of the titanium-copper alloy at high temperatures.

The average grain size of the titanium-copper alloy strip is less than or equal to 20 μm. The metallographic phase of the conventional titanium-copper alloy with Nb or Al or without Nb and Al both is shown in FIG. 2-4: the average grain size is all 30 μm or more, except for a small amount of inclusions at the grain boundaries, there is no material particles inside the grains. In contrast, after the same process, the metallographic phase of the titanium-copper alloy containing Nb and Al of the present invention is shown in FIG. 1: the average grain size is 18 μm, which is at least 40% lower than that of Cu—Ti alloy in the prior arts. During the production of alloy, the control of the grain size will directly affect the properties of the final product. In the production of common copper alloys, the crystal grain size is mainly controlled by adjusting the solution treatment temperature and time. However, when the treatment time is reduced to a certain value, the allowable process error range will be drastically reduced, which will reduce the yield in production. The growth of crystal grains is mainly accomplished by the migration of grain boundaries. Nano-scale Nb and Al-containing intermetallic compound particles stably exist in the matrix at high temperatures, which restrict the growth of the matrix grains by hindering the movement of the grain boundaries. Even if the solution time is longer, the grain refinement effect is still very significant. This grain refinement effect is very important to the improvement of the product's mechanical properties and yield.

As mentioned above, the titanium-copper alloy strip has excellent high temperature stability. The alloy strip has a decline rate H of hardness <5% after being held at 500° C. in atmospheric environment for 1 hour. In the prior arts, the indicator to evaluate the high-temperature stability properties of the copper alloy is mainly the high-temperature softening temperature of the copper alloy. The national standard "GB/T33370-2016, Measuring Method for Copper and Copper Alloy Soften Temperature" specifies that after holding at a certain temperature for 1 hour, when the hardness of copper alloy decreases to 80% of the original hardness, the corresponding holding temperature is the high temperature softening temperature of copper alloy. However, the softening degree of the alloy is not linearly related to the holding temperature of the alloy. Generally, the higher the temperature of the alloy, the faster its properties changes. With the increasing complexity of product processing technology and applications, only considering the high-temperature softening temperature of alloys may not meet the requirements of the design and application of products. In the present invention, the decline rate of hardness of the alloy at a certain holding temperature is used to characterize the stability of the mechanical properties of the titanium-copper alloy at high temperatures, which can more objectively reflect the property changes of the alloy at high temperatures, thereby facilitating the design of processing process and application of products.

The decline rate of hardness H of the conventional titanium-copper alloy is greater than 10% after being held at 500° C. in atmospheric environment for 1 hour. The decline rate of hardness of the titanium-copper alloy of the present invention is much lower than that of the conventional titanium-copper alloy. This excellent high temperature stability enables the titanium-copper alloy strip to maintain stable properties in different processing and application scenarios, which is beneficial to expand the application of the titanium-copper alloy strip.

Preferably, one or more elements of Ni, Co, Fe, Sn, Mn, Si, Cr, Mg, B, Zr or Ag with a total weight percentage of not more than 0.50 wt % can be added to the titanium-copper alloy. Among them, Ni, Co, Fe, Sn, Mn, Si, Cr, Mg, B will form intermetallic compounds with Nb and Al to further improve the stability of the strip, but adding too much of these elements will reduce the amount of CuTi precipitation phase, which will reduce the mechanical properties of the strip. Zr and Ag can solubilize in copper to increase the strength of the strip without reducing the electrical conductivity. Therefore, the total amount of Ni, Co, Fe, Sn, Mn, Si, Cr, Mg, B, Zr or Ag and a combination thereof in the titanium-copper alloy strip of the present invention does not exceed 0.50 wt %.

It should be pointed out that the titanium-copper alloy strip of the present invention has a closed composition. In addition to the above-mentioned essential elements Ti, Nb, Al and optional elements Ni, Co, Fe, Sn, Mn, Si, Cr, Mg, B, Zr or Ag, the balance of the titanium-copper alloy strip is Cu and inevitable impurities. If any element other than the above-mentioned elements is added, even in a small amount, it will have an adverse effect on the comprehensive properties of the titanium-copper alloy strip, especially the bendability, yield strength and high temperature stability.

The present invention also relates to a method for producing the titanium-copper alloy strip containing Nb and Al as described above, which includes the following steps:

1) Casting: the copper alloy raw materials are melted at 1200-1400° C. by using vacuum or gas-protected smelting method;
2) hot working: the ingot is subjected to hot working at a temperature of 700-980° C., and the cross-sectional area of the ingot is controlled to have a reduction of not less than 75% by the hot working;
3) Milling: the material obtained by hot working is subjected to milling;
4) First cold rolling: the cross-sectional area of the material is controlled to have a reduction of not less than 70%;
5) Solid solution treatment: the cold-rolled material is heated to a temperature of 700-950° C. and held for 1-100 s, followed by water cooling or air cooling, wherein the cooling rate is 10-250° C./s;
6) Intermediate cold rolling: the cross-sectional area of the material is controlled to have a reduction of 5-99%;
7) First aging: a temperature of 350-500° C. is held for 0.5-24 h under inactive gas protection;
8) Final cold rolling: the cross-sectional area is controlled to have a reduction of 5-80%;
9) Second aging: a temperature of 200-550° C. is held for 1 min-10 h under inactive gas protection.

Preferably, the casting in step 1) is iron mold casting, horizontal continuous casting or vertical semi-continuous casting.

Preferably, the hot working in step 2) is hot forging, hot rolling, or a combination thereof.

More preferably, in the above hot forging, the holding temperature for the hot forging is controlled at 700-980° C., the holding time is 1-12 h, and the initial forging temperature is controlled at 700-980° C. Free forging or die forging is used. When the temperature decreases and deformation is difficult, reheating is performed to increase the temperature of the billet.

Still further preferably, in the above hot rolling, the holding temperature for the hot rolling is controlled at 700-980° C., the holding time is 1-12 h, the initial rolling temperature is controlled at 700-980° C., the hot rolling speed is 5-200 m/min, and the final rolling temperature is not lower than 500° C., the rolling reduction is controlled to be 75% or higher, and on-line water-cooling is performed after rolling. If the final rolling temperature is lower than 500° C., because the rolled piece is thin and long in the later stage of hot rolling, big temperature drop will cause the large temperature difference between the head and tail of the rolled piece and the middle of the rolled piece, which will lead to the precipitation of the second phase, resulting in ununiform microstructure, reducing material plasticity, easily forming cracks. Preferably, multi-pass cold rolling is performed in step 6), and the deformation amount in a single pass is controlled at 5%-20%.

During the rolling, the crystal rotation promotes the propagation of dislocations and the disordered arrangement of atoms. The increased energy storage and lattice defects in the material etc. are advantageous for the progress of spinodal decomposition or the precipitation of strengthening phases in the aging process, which can significantly increase the strength of the alloy. The deformation amount in a single pass is controlled at 5%-20%, so that the force in the thickness direction of the rolling deformation is more uniform, which is beneficial to control the plate shape.

Preferably, the solid solution treatment in step 5) and the intermediate cold rolling in step 6) are used as a step unit, and the step unit is repeated at least twice, wherein the cross-sectional area of the intermediate cold-rolled material between two adjacent solid solution treatments is reduced by ≥30%.

Preferably, the aging in step 7) is performed in an atmosphere containing hydrogen, nitrogen, argon, or any mixture of these gases.

Preferably, after the solution treatment and/or after aging, polishing and pickling steps for removing surface oxide scale are performed.

The key steps in the above methods need to be explained as follows:

In step 1), the vacuum smelting method is adopted, in which the first step is: adding electrolytic copper and Nb-containing master alloy simultaneously in the smelting furnace and smelting; the second step is: after the electrolytic copper and Nb-containing master alloy are completely melted, adding Ti-containing and Al-containing raw materials and optionally one or more raw materials containing one or more of Ni, Co, Fe, Sn, Mn, Si, Cr, Mg, B, Zr and Ag; the third step is: after all the raw materials are melted, refining is performed at 1300±50° C. for 30-60 min. Nb has a melting point as high as 2469° C., and its solid solubility in Cu is very low. Adding the Nb-containing master alloy and electrolytic copper simultaneously in the smelting furnace can maximize the smelting time of Nb, thereby promoting the melting of Nb. If the smelting time of Nb is too short, elemental Nb particles with larger sizes are likely to appear in the ingot, which affects the quality of the ingot. It needs to be emphasized that the refining in step 1) will directly affect the stability of the mechanical properties of the titanium-copper strip of the present invention at high temperatures. Appropriate refining time facilitates the generation of nano-scale Nb and Al-containing intermetallic compounds, and facilitates the dispersion of nano-scale Nb and Al-containing intermetallic compound particles in the ingot. If the refining time is too short, a sufficient amount of Nb and Al-containing intermetallic compounds cannot be formed; if the refining time is too long, the nano-level Nb and Al-containing intermetallic compound particles are prone to agglomeration and growth, which will affect The properties of the final alloy.

In step 1), the Nb-containing master alloy may be a Cu—Nb master alloy or a Nb—Ti master alloy, and the Ti-containing and Al-containing raw materials may be pure Ti, pure Al or a Ti and/or Al-containing master alloy, and one or more raw materials containing one or more of Ni, Co, Fe, Sn, Mn, Si, Cr, Mg, B, Zr and Ag may be elementary substances of these elements or master alloys containing these elements.

In step 7) and step 9), the alloy is aged twice. The main purpose of the first aging is to form a spinodal decomposition microstructure, increase the precipitation of β'-$Cu_4Ti$ phase, thereby achieving a strengthening effect. In order to further strengthen the alloy after the first aging, it is necessary to perform a cold rolling process on the alloy. However, cold deformation will produce a large number of movable dislocations inside the alloy. These dislocations are more likely to move at high temperatures, which will greatly affect the stability of the mechanical properties of the alloy at high temperatures. The second aging can effectively reduce the density of movable dislocations in the alloy caused by the last cold rolling so as to improve the stability of microstructure and properties of titanium-copper strip at room temperature and high temperature.

The above steps 1)-9) must be carried out in the order shown. If the order of the steps shown is changed or one or more of the above steps are omitted, or one or more of the above steps are replaced with other steps, the comprehensive properties of the titanium-copper alloy strip, especially the stability of mechanical properties at high temperatures will be significantly impacted.

The beneficial effects of the present invention

Compared with the prior arts, the advantages of the present invention are:

(1) The titanium-copper alloy strip containing Nb and Al of the present invention exhibits excellent high-temperature stability: the decline rate of hardness H is <5% after being held at 500° C. in atmospheric environment for 1 hour for the alloy.

(2) The titanium-copper alloy strip containing Nb and Al of the present invention can realize the ratio of the bending radius parallel to the rolling direction (i.e. good direction) to the thickness of the strip $R_1/T \leq 0.5$, and the ratio of the bending radius perpendicular to the rolling direction (i.e. bad direction) to the thickness of strip $R_2/T \leq 1.0$. This excellent bendability enables the titanium-copper alloy strip to tolerate severe bending in different directions at the same time, making it suitable for the production of small and complex-shaped terminals for consumer electronics and other connector-related industries.

The "strip" as recited herein is a common material form in the art, with a thickness usually not more than 1 mm.

Unless otherwise indicated, all numbers indicating amounts of ingredients, chemical and mechanical properties, process conditions, etc. used in the specification and claims should be understood as being modified by the term "about" in all cases. Therefore, unless stated to the contrary, the numerical parameters set forth in the specification and appended claims are approximate values that may vary depending on the desired properties sought to be obtained by the exemplary embodiments herein. At least each numerical parameter should be interpreted according to the value of significant figures and common rounding methods.

Although the wide ranges of numerical values and parameters that illustrate the exemplary embodiments are approximate values, the numerical values set forth in the specific examples are reported as accurately as possible. However, any numerical value inherently contains certain errors inevitably produced by the standard deviation found in their respective test measurements. Each numerical range given in the entire specification and claims shall include each narrower numerical range falling within such a wider numerical range, as if such narrower numerical ranges are also expressly written herein. In addition, any numerical value reported in the examples can be used to define the upper end or the lower end of the wider composition range disclosed herein.

EMBODIMENTS

Figure 1:
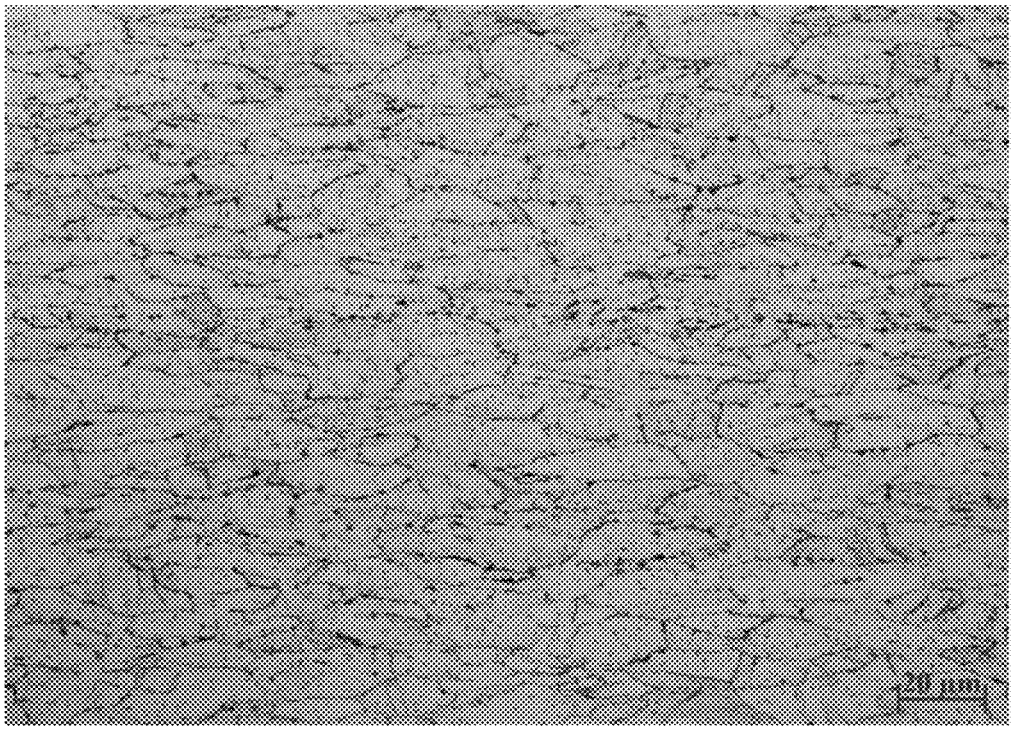
FIG. 1 is the metallographic structure of the Cu—Ti—Nb—Al alloy strip according to the present invention.
Figure 2:
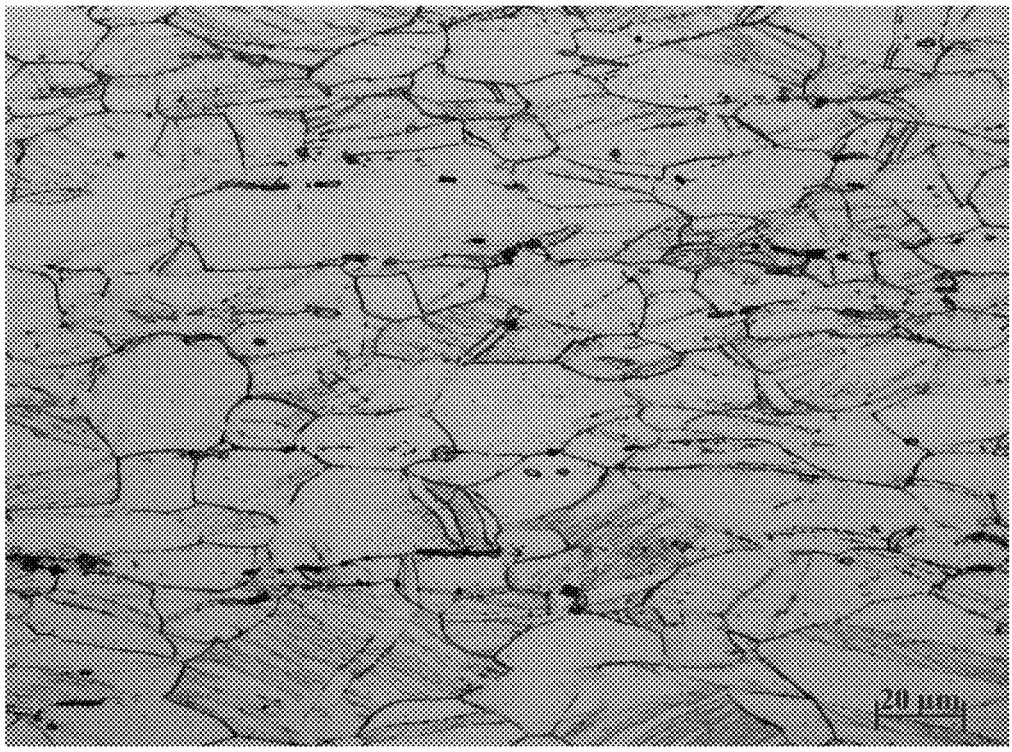
FIG. 2 shows the metallographic structure of a Cu—Ti alloy strip in the prior arts.
Figure 3:
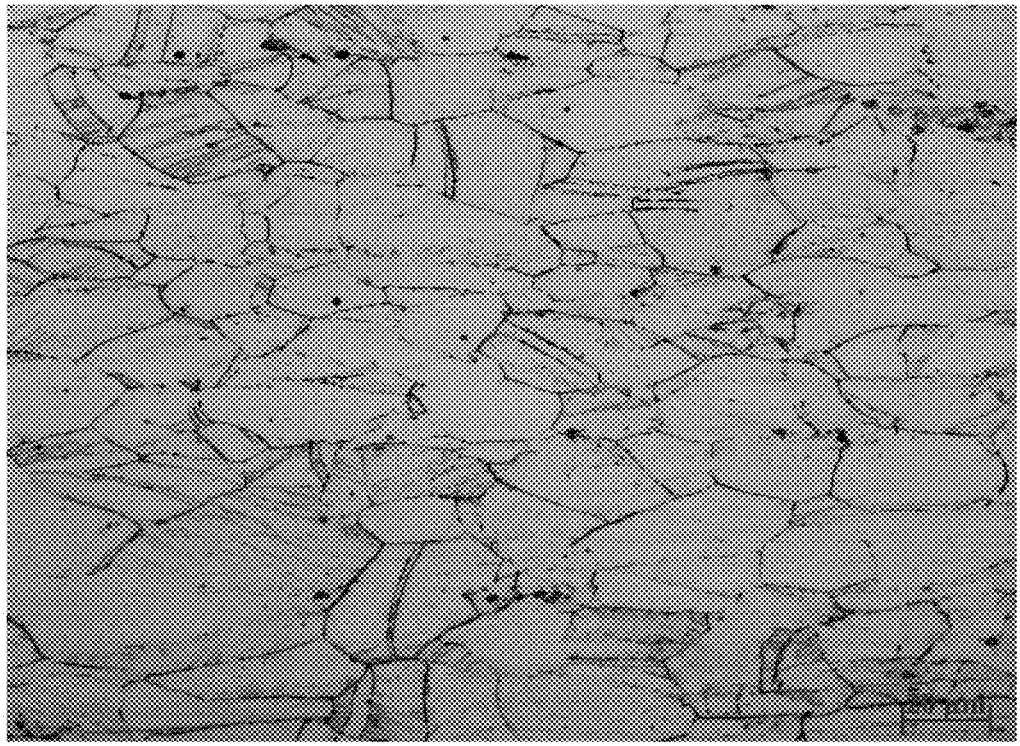
FIG. 3 shows the metallographic structure of a Cu—Ti—Nb alloy strip in the prior arts.
Figure 4:
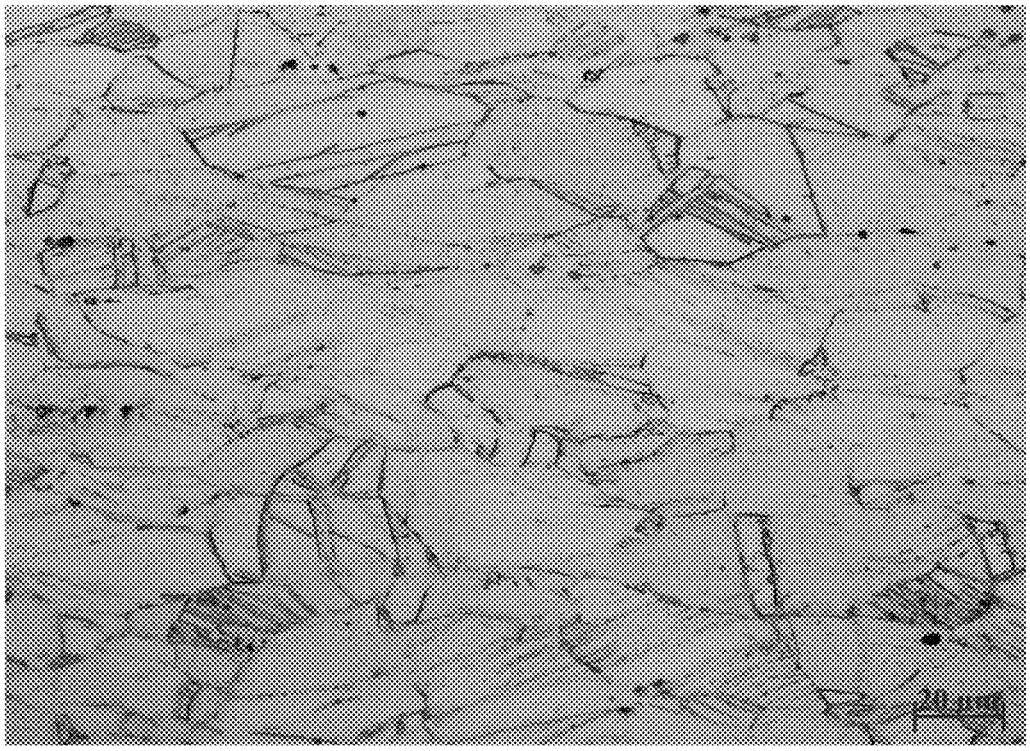
FIG. 4 shows the metallographic structure of a Cu—Ti—Al alloy strip in the prior arts.
Figure 5:
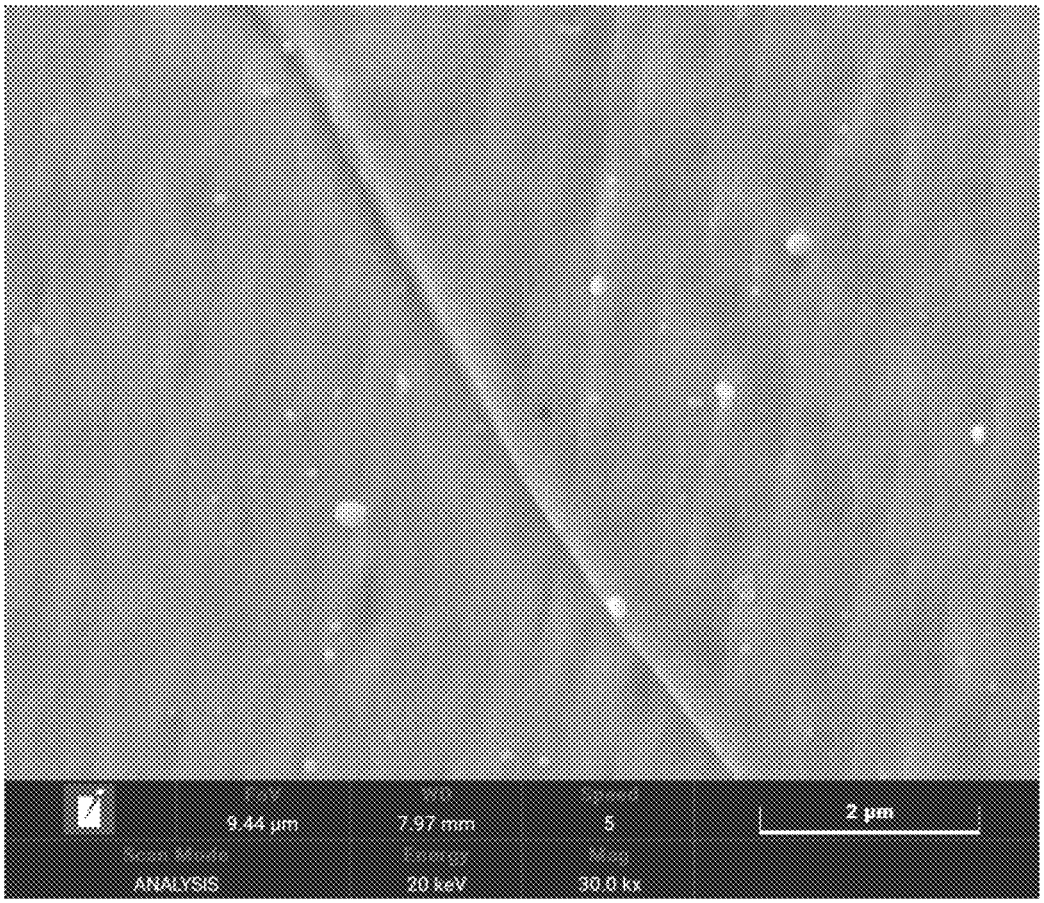
FIG. 5 is the scanning electron micrograph of a Nb and Al-containing intermetallic compound in the Cu—Ti—Nb—Al alloy strip according to the present invention.

The present invention will be further described in detail below by reference with the drawings and examples.

20 example alloys and 10 comparative example alloys were designed. Each alloy was prepared according to the requirements of the addition amount of alloy raw materials (see Table 1 below) using forementioned two-step smelting method of adding alloy raw materials: the first step: electrolytic copper and Cu—Nb master alloy were added simultaneously in a smelting furnace and smelted; the second step: after the electrolytic copper and Cu—Nb master alloy were completely melted, according to the composition in Table 1, pure Ti, pure Al and elementary substances of optional elements selected from Ni, Co, Fe, Sn, Mn, Si, Cr, Mg, B, Zr and Ag were added successively; the third step: after all the raw materials were melted, refining was carried out at 1300±50° C. for 30-60 min. After smelting, a rectangular ingot was cast by a vertical semi-continuous casting method.

The ingot was held at 800-950° C. for 1-12 h and then hot rolled, the hot rolling speed was 50-120 m/min, the reduction in single pass of rolling was controlled at 10-30%, and the final rolling temperature was 650° C. or higher, after hot rolling, on-line water cooling was performed, followed by milling.

Subsequently, the first cold rolling was carried out, and the total cold rolling reduction was controlled above 80%.

After the first cold rolling, solid solution treatment was carried out. The temperature for the solid solution treatment was 700-950° C., the holding time was 1-100 s, and the cooling rate was 10-250° C./s.

After the solid solution treatment, an intermediate cold rolling was carried out. The rolling reduction was controlled at 30-60%, and the reduction in single pass was controlled at 5-20%.

After the intermediate cold rolling, the second solid solution treatment was carried out. The temperature for the solid solution treatment was 700-950° C., the holding time was 1-100 s, and the cooling rate was 10° C./s-250° C./s.

After the second solid solution treatment, an intermediate cold rolling was carried out again. The rolling reduction was controlled at 10-60%, and the reduction in single pass was controlled at 5-20%.

It should be noted that although a specific rolling reduction and two solution treatments and two intermediate cold rolling were involved in the above intermediate cold rolling steps, according to the actual product specifications, the rolling reduction can be varied within the range of 5-99%, and the solid solution treatment and the intermediate cold rolling can be carried out once or twice or more.

Subsequently, the first aging was carried out in an atmosphere containing hydrogen, nitrogen, argon, or any mixture of these gases. The aging temperature was 400° C. and the holding time was 4 h.

After the first aging, the final cold rolling was carried out, and the rolling reduction was controlled at 10-30%. It should be noted that although a specific rolling reduction was involved in the final cold rolling step here, the rolling reduction can be varied within the range of 5-80% according to the actual product specifications.

Finally, the second aging was carried out in an atmosphere containing hydrogen, nitrogen, argon, or any mixture of these gases. The aging temperature was 350° C. and the holding time was 4 h.

It should be noted that although a specific gas atmosphere was used in the first and second aging processes, it should be understood that other inert gases may also be used as the protective atmosphere.

Subsequently, the number of Nb and Al-containing intermetallic compound particles with a particle size of 50-500 nm and the number of Nb and Al-containing intermetallic compound particles with a particle size >1 μm in the alloy were measured, and the mechanical properties, electrical conductivity, bendability and the stability of mechanical properties at high temperature of the resulting alloy strip were tested.

It should be noted that, in order to avoid making the specification of the present application excessively lengthy, the detailed process parameters of Example 12 are described below as an example. Although the detailed process parameters of other examples are not recorded, it should be understood that the disclosures of the specification are sufficient for those skilled in the art to implement the invention claimed in this application, and such disclosures can also fully support the protection scope claimed by the claims.

In Example 12, the specification of the thickness of the finished product was 0.15 mm, and the specific process was as follows:

The ingredients of the alloy were added according to the amount of the raw materials of the alloy in Example 12 and smelted. The first step: electrolytic copper and Cu—Nb master alloy were added simultaneously in a smelting furnace and smelted; the second step: after the electrolytic copper and Cu—Nb master alloy were completely melted, pure Ti, pure Al and pure Co were added successively; the third step: after all the raw materials were melted, refining was carried out at 1300° C. for 45 min. After the smelting, a rectangular ingot was cast by a vertical semi-continuous casting method.

The ingot was held at 930° C. for 8 h and then hot rolled. The hot rolling speed was 110 m/min, the single pass reduction of rolling was 30%, and the final rolling temperature was 650° C. or higher, after the hot rolling, on-line water cooling was carried out, followed by milling.

Subsequently, the first cold rolling was carried out, and the total cold rolling reduction was 90%.

After the first cold rolling, solid solution treatment was carried out. The temperature for the solid solution treatment was 700° C., the holding time was 80 s, and the cooling rate was 100° C./s.

After the solid solution treatment, an intermediate cold rolling was carried out. The rolling reduction was controlled at 55%, and the reduction in single pass was controlled at 20%.

After the intermediate cold rolling, the second solid solution treatment was carried out. The solid solution temperature was 950° C., the holding time was 5 s, and the cooling rate was 200° C./s.

After the second solid solution treatment, an intermediate cold rolling was carried out again. The rolling reduction was controlled at 20%, and the reduction in single pass was controlled at 5%.

Subsequently, the first aging was carried out in an atmosphere containing a mixture of hydrogen and argon. The aging temperature was 400° C. and the holding time was 4 h.

After the first aging, the final cold rolling was carried out. The rolling reduction was 20%, and the final thickness was 0.15 mm.

Finally, the second aging was carried out in an atmosphere containing a mixture of hydrogen and argon at a temperature of 350° C. for 4 hours to obtain the finished material.

Standard Tests:

The room temperature tensile test was carried out on the electronic universal mechanical testing machine in accordance with "GB/T228.1-2010, Metallic Material Tensile Test, Part 1: Room Temperature Test Method". The sample adopts a rectangular cross-section proportional sample with a proportionality factor of 5.65. The yield strength of the strips of the examples of the present invention and the comparative examples given in Table 1 below was the yield strength in the direction parallel to rolling direction.

The electrical conductivity was tested in accordance with "GB/T3048-2007, Test Method for Electrical Properties of Wires and Cables, Part 2: Metallic Material Resistivity Test", expressed in % IACS.

The bendability was measured by the following method: take a long strip sample of the copper alloy strip in the rolling direction (i.e. good direction), and take a long strip sample perpendicular to the rolling direction (i.e. bad direction). The width of the samples was 10 mm. A 90° V-shaped punch with different radii at the tip was used to bend the long strip samples, and the outer surface of the bend was observed using a stereomicroscope. The bendability was expressed by the minimum bending radius/strip thickness (R/T) without cracks on the surface. When R/T value is 0, the minimum bending radius R is 0 and the bendability is the best.

The average grain size was measured in accordance with the test method of "YS/T 347-2004, Measuring Method for Average Grain Size of Copper and Copper Alloy".

The stability test of mechanical properties at high temperature was carried out with reference to "GB/T33370-2016, Measuring method for Softening Temperature of Copper and CopperAlloy". The sample was held at 500° C. in air for 1 hour and then air-cooled to test the hardness of the sample. the decline rate of hardness H (%) of the sample after being held at a certain high temperature compared with the original sample is used to characterize the stability of the mechanical properties of the sample at high temperature. The lower the decline rate of hardness H at the same temperature, the better the stability of the mechanical properties at high temperature.

The grain size and the distribution of intermetallic compound particles of the alloys were observed by metallographic microscope. The intermetallic compound particles in the alloy were observed using scanning electron microscope and their size and quantity were counted. The specific operation mode was as follows: a section parallel to the rolling direction of copper alloy strip was taken, and a rectangle of 25 μm×40 μm (1000 $\mu m^2$) was taken as basic unit to observe its microstructure; 10 rectangles at different positions in the field of vision were selected, and the number of particles with a particle size between 50-500 nm and the number of particles with a particle size greater than 1 μm in each rectangle were counted. Finally, the average value was taken as the judgment basis, and the particle size was defined as the maximum size of particles.

According to Examples 1-20, it can be found that by reasonable control of the content of Ti, Nb, and Al, the copper alloys of all the examples in the present invention have achieved the properties of yield strength ≥900 MPa, electrical conductivity ≥10% IACS while exhibiting excellent bendability, i.e. the ratio of the bending radius parallel to rolling direction (i.e. good direction) to the thickness of strip ($R_1$/T) ≤0.5, the ratio of the bending radius perpendicular to rolling direction (i.e. bad direction) to the thickness of strip ($R_2$/T)≤1.0. After 500° C. soaking tests, it was found that the alloy samples in Example 1-20 had a decline rate of hardness H<5%.

Examples 1-20 and Comparative Examples 1-10 reflected the effects of different Nb and Al contents and the number of Nb and Al-containing intermetallic compound particles on the comprehensive properties of the titanium-copper alloy strip. Meanwhile, Examples 1-20 also showed that addition of one or more optional elements selected from Si, Zn, Co, Fe, Sn, Mn, Mg, Cr, B, Ag, and Zr in a reasonable small amount improved the strength and high temperature stability of the alloy to a certain extent.

The composition, the number of Nb and Al-containing intermetallic compound particles and the property test results of the titanium-copper alloy strips of Examples 1-20 and Comparative Examples 1-10 were shown in Table 1.

Although the yield strength and bending property of the titanium-copper alloy strips of Comparative Examples 1-5 meet the requirements, because Nb and Al were not added (Comparative Example 1) or Nb and Al were not added simultaneously (Comparative Example 2-5), there was no Nb and Al-containing intermetallic compound particles in the matrix, so the decline rate of hardness H was high (H>10%). Although both Nb and Al were added in Comparative Examples 6 and 7, the Nb content was insufficient in Comparative Example 6, and the Al content was insufficient in Comparative Example 7, which could not produce sufficient Nb and Al-containing intermetallic compound particles, therefore, exhibiting a weak strengthening effect, therefore, the decline rate of hardness H was still high (H>10%).

Comparative examples 8-10 showed that although the decline rate of hardness H<5%, the yield strength and bendability of the titanium-copper alloy were adversely affected due to the excessive Al and/or Nb content. Especially when Al and Nb contents were simultaneously excessive, they agglomerated into large precipitate particles, which was disadvantageous for improving the strength of the alloy, and increased the risk of cracking during bending ($R_1$/T and $R_2$/T were larger in Comparative Example 10).

TABLE 1

Composition, number of Nb and Al-containing intermetallic compound particles and property test results of Examples and Comparative Examples

| | Element content | | | | | Nb and Al-containing intermetallic compound particles | | Properties | | | | |
|---|---|---|---|---|---|---|---|---|---|---|---|---|
| Example | Cu wt % | Ti wt % | Nb wt % | Al wt % | Other wt % | Number of particles with particle size of 50-500 nm × $10^4$/mm$^2$ | Number of particles with particle size > 1 μm × $10^2$/mm$^2$ | Yield strength MPa | Conductivity % IACS | 90° Bending GW $R_1$/T | 90° Bending BW $R_2$/T | Decline rate of hardness H % |
| 1 | Rem. | 2.07 | 0.305 | 0.012 | — | 21 | 3 | 903 | 20.0 | 0 | 0 | 4.6 |
| 2 | Rem. | 2.35 | 0.135 | 0.244 | — | 88 | 5 | 911 | 19.1 | 0 | 0.1 | 3.5 |
| 3 | Rem. | 2.59 | 0.048 | 0.098 | — | 58 | 4 | 919 | 17.9 | 0 | 0.2 | 4.8 |
| 4 | Rem. | 2.84 | 0.013 | 0.169 | — | 15 | 3 | 924 | 17.5 | 0.2 | 0.4 | 4.5 |
| 5 | Rem. | 3.10 | 0.063 | 0.058 | — | 78 | 4 | 913 | 16.2 | 0 | 0.4 | 3.9 |
| 6 | Rem. | 3.21 | 0.032 | 0.015 | — | 35 | 1 | 935 | 15.6 | 0 | 0.4 | 4.1 |
| 7 | Rem. | 3.25 | 0.212 | 0.124 | — | 91 | 4 | 949 | 15.1 | 0.1 | 0.4 | 2.9 |
| 8 | Rem. | 3.27 | 0.006 | 0.215 | — | 14 | 5 | 955 | 14.3 | 0.2 | 0.6 | 4.7 |
| 9 | Rem. | 3.36 | 0.084 | 0.154 | — | 77 | 4 | 954 | 13.1 | 0.2 | 0.6 | 3.9 |
| 10 | Rem. | 3.41 | 0.113 | 0.301 | — | 58 | 6 | 946 | 12.9 | 0.2 | 0.4 | 4.5 |
| 11 | Rem. | 3.46 | 0.294 | 0.195 | Ni: 0.15 B: 0.05 | 102 | 5 | 959 | 13.2 | 0.4 | 0.8 | 3.1 |
| 12 | Rem. | 3.49 | 0.168 | 0.169 | Co: 0.05 | 81 | 5 | 957 | 12.3 | 0.4 | 0.8 | 3.8 |
| 13 | Rem. | 3.51 | 0.068 | 0.188 | Fe: 0.25 | 44 | 4 | 968 | 12.4 | 0.4 | 0.6 | 2.9 |
| 14 | Rem. | 3.59 | 0.156 | 0.023 | Sn: 0.14 | 36 | 5 | 979 | 11.0 | 0.4 | 0.6 | 4.2 |
| 15 | Rem. | 3.61 | 0.137 | 0.224 | Mn: 0.18 | 74 | 6 | 975 | 11.6 | 0.4 | 0.4 | 4.5 |
| 16 | Rem. | 3.69 | 0.021 | 0.058 | Si: 0.08 | 60 | 6 | 982 | 10.7 | 0 | 0.4 | 3.8 |
| 17 | Rem. | 3.75 | 0.368 | 0.119 | Cr: 0.19 | 99 | 4 | 988 | 10.5 | 0.4 | 0.8 | 3.7 |
| 18 | Rem. | 3.96 | 0.116 | 0.01 | Mg: 0.30 | 19 | 5 | 984 | 10.3 | 0.4 | 0.8 | 4.1 |
| 19 | Rem. | 4.11 | 0.156 | 0.455 | Zr: 0.09 | 87 | 7 | 979 | 10.2 | 0.4 | 0.6 | 3.6 |
| 20 | Rem. | 4.33 | 0.075 | 0.364 | Ag: 0.26 | 51 | 4 | 991 | 10.1 | 0.4 | 0.6 | 3.3 |

| | Element content | | | | | Nb and Al-containing intermetallic compound particles | | Properties | | | | |
|---|---|---|---|---|---|---|---|---|---|---|---|---|
| Comparative examples No. | Cu wt % | Ti wt % | Nb wt % | Al wt % | Other wt % | Number of particles with particle size of 50-500 nm × $10^4$/mm$^2$ | Number of particles with particle size > 1 μm $10^3$/mm$^2$ | Yield strength MPa | Conductivity % IACS | 90° Bending GW $R_1$/T | 90° Bending BW $R_2$/T | Decline rate of hardness H % |
| 1 | Rem. | 3.22 | — | — | — | — | — | 921 | 13.2 | 0 | 0.4 | 12.8 |
| 2 | Rem. | 3.25 | — | 0.084 | — | — | — | 926 | 14.1 | 0.2 | 0.4 | 10.7 |
| 3 | Rem. | 3.23 | — | 0.203 | — | — | — | 914 | 13.3 | 0.2 | 0.4 | 10.5 |
| 4 | Rem. | 3.26 | 0.046 | — | — | — | — | 917 | 14.9 | 0.4 | 0.6 | 11.3 |
| 5 | Rem. | 3.30 | 0.115 | — | — | — | — | 909 | 15.1 | 0.2 | 0.6 | 11.2 |
| 6 | Rem. | 3.34 | 0.003 | 0.086 | — | 0.7 | 2 | 945 | 15.7 | 0 | 0.2 | 10.2 |
| 7 | Rem. | 3.30 | 0.08 | 0.002 | — | 1.0 | 2 | 957 | 14.8 | 0.2 | 0.2 | 10.5 |
| 8 | Rem. | 2.99 | 0.61 | 0.19 | — | 67 | 13 | 889 | 16.6 | 0.8 | 1.0 | 3.9 |
| 9 | Rem. | 3.15 | 0.083 | 0.568 | — | 75 | 11 | 878 | 16.5 | 0.6 | 0.8 | 4.3 |
| 10 | Rem. | 3.25 | 0.583 | 0.668 | — | 63 | 26 | 904 | 12.0 | 1.6 | 2.0 | 4.5 |

The invention claimed is:

1. A Nb and Al-containing titanium-copper alloy strip, characterized in that the weight percentage composition of the titanium-copper alloy strip comprises:

2.0-4.5 wt % Ti, 0.005-0.40 wt % Nb, and 0.01-0.50 wt % Al, the balance being Cu and unavoidable impurities; and further characterized in that in the titanium-copper alloy strip, the number of Nb and Al-containing intermetallic compound particles with a particle size of 50-500 nm is not less than $1\times10^5$/mm$^2$, and the number of Nb and Al-containing intermetallic compound particles with a particle size greater than 1 μm is not more than $1\times10^3$/mm$^2$; and the titanium-copper alloy strip has a ratio of the bending radius parallel to the rolling direction to the thickness of the strip $R_1/T\leq0.5$, and a ratio of the bending radius perpendicular to the rolling direction to the thickness of the strip $R_2/T\leq1.0$; and/or the titanium-copper alloy strip has a yield strength of greater than 900 MPa and an electrical conductivity of 10-20% International Annealed Copper Standard.

2. The Nb and Al-containing titanium-copper alloy strip according to claim 1, characterized in that the weight percentage composition of the titanium-copper alloy strip comprises:

2.5-4.0 wt % Ti, 0.01-0.3 wt % Nb, and 0.05-0.3 wt % Al.

3. The Nb and Al-containing titanium-copper alloy strip according to claim 2, characterized in that the weight percentage composition of the titanium-copper alloy strip comprises 2.9-3.5 wt % Ti.

4. The Nb and Al-containing titanium-copper alloy strip according to claim 1, characterized in that the titanium-copper alloy strip has a decline rate of hardness H<5% after being held at 500° C. in atmospheric environment for 1 hour.

5. The Nb and Al-containing titanium-copper alloy strip according to claim 1, characterized in that the weight percentage composition of the titanium-copper alloy strip also comprises a total amount of 0-0.50 wt % of one or more selected from Ni, Co, Fe, Sn, Mn, Si, Cr, Mg, B, Zr, and Ag.

6. The Nb and Al-containing titanium-copper alloy strip according to claim 1, characterized in that the weight percentage composition of the titanium-copper alloy strip comprises 2.9-3.5 wt % Ti.

* * * * *